United States Patent [19]

Samuelsson

[11] Patent Number: 4,468,833

[45] Date of Patent: Sep. 4, 1984

[54] TOOL HOLDERS FOR USE ON LOUVERS

[76] Inventor: Soren Samuelsson, 74-259 Candlewood St., Palm Desert, Calif. 92260

[21] Appl. No.: 438,763

[22] Filed: Nov. 3, 1982

[51] Int. Cl.[3] ..... B60S 1/04

[52] U.S. Cl. ..... 15/245; 15/210 A; 15/250.28

[58] Field of Search ..... 15/210 A, 244 A, 245, 15/250.28, 394

[56] References Cited

U.S. PATENT DOCUMENTS

| | | | |
|---|---|---|---|
| 2,139,537 | 12/1938 | Bassin | 15/210 A X |
| 2,319,355 | 5/1943 | Storey | 15/245 |
| 2,903,727 | 9/1959 | Rattay | 15/245 X |
| 2,957,190 | 10/1960 | Stark | 15/210 A X |
| 4,085,478 | 4/1978 | Bailes et al. | 15/210 A X |

FOREIGN PATENT DOCUMENTS

| | | | |
|---|---|---|---|
| 272651 | 6/1927 | United Kingdom | 15/210 A |
| 1071271 | 6/1967 | United Kingdom | 15/210 A |

*Primary Examiner*—Chris K. Moore

*Attorney, Agent, or Firm*—Fulwider, Patton, Rieber, Lee & Utecht

[57] ABSTRACT

A tool holder adapted for use with slat-like material, such as louver window panels, venetian blinds, and vertical drapes, is devised to simultaneously bring a pair of tool elements to bear against the opposing surfaces of the slat-like material. Thus, the slat-like material can be easily and quickly cleaned with a single smooth motion of the tool. The tool includes first and second handle segments which are rotatably coupled together at one end. The lower handle segment includes an integrally formed tool holding portion. The opposing upper handle segment is rotatably coupled to an adjustable tool holding element which opposes the tool holding portion of the lower handle segment. The angular orientation of the adjustable tool holding element is selectively fixed with respect to the upper handle segment so that it and the opposing tool holding portion can be aligned in a substantially parallel configuration notwithstanding the variable distance of separation therebetween. Tool elements inserted into the tool holding element and tool holding portion can thus be oriented in a mutually opposing and parallel configuration with the slat-like material disposed therebetween in contact with the operative edges of the tool elements.

5 Claims, 7 Drawing Figures

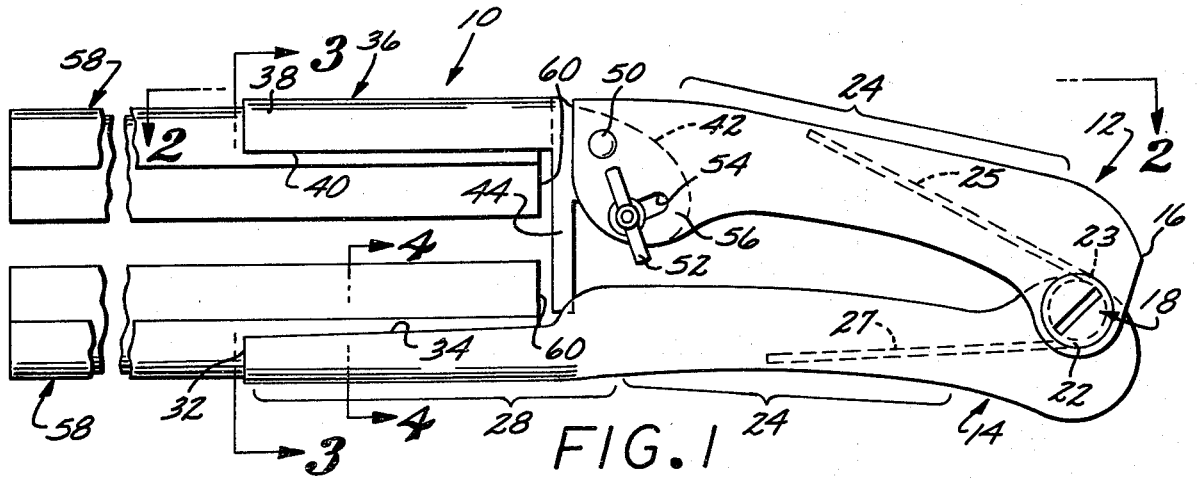
FIG. 1
FIG. 2
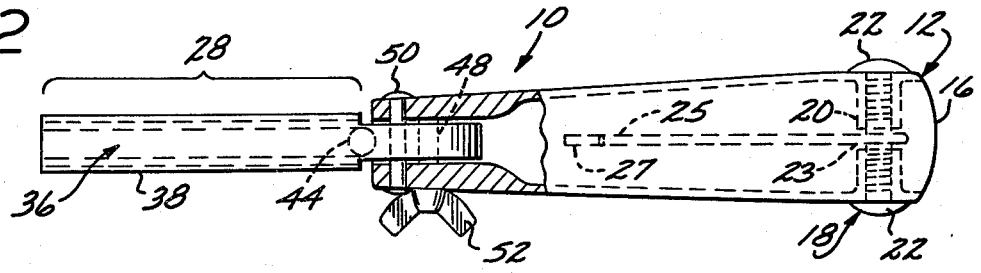
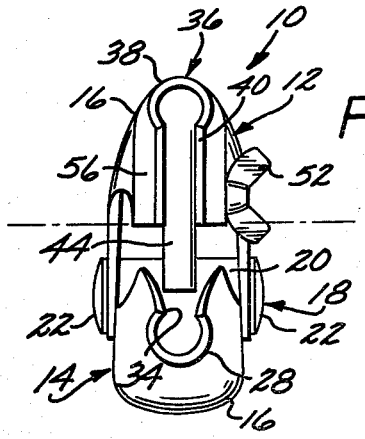
FIG. 3
FIG. 4
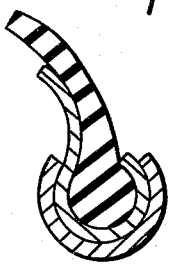
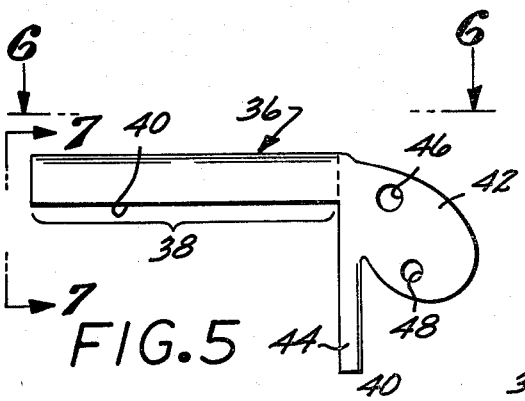
FIG. 5
FIG. 7
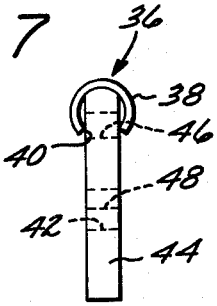
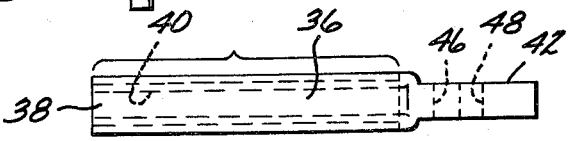
FIG. 6

TOOL HOLDERS FOR USE ON LOUVERS

BACKGROUND OF THE INVENTION

1. Field of the Invention

The present invention relates to the field of tool holders and particularly to tool holders which are adapted to hold tools which are used on louvers and other slat-like material.

2. Description of the Prior Art

Glass louvered windows have rapidly been incorporated in contemporary construction as the design and cost of louvered mechanisms decreases and the popular appeal of louvered windows increases. Much of the popular appeal of a glass louvered window derives from the fact that it is a see through window which can be opened to any extent desired. As with all exterior windows, louvered windows become coated with dust, oil, dirt and other common air borne debris, which over a course of time substantially degrades the attractiveness and transparency of the window. Louver windows are particularly susceptible to fouling due to the fact that they offer a nonplanar, lapped surface to catch air borne debris. Furthermore, when the louvered window is opened, the exterior glass surface angles inwardly and any fouling is readily noticeable to the user, particularly if the user brushes against or touches the fouled surface of the window. As a consequence, louvered windows must be periodically cleaned in order to maintain their attractive appearance and appeal.

Because of the large number of slats or glass panes which are presented by a louvered window and because both surfaces of the window must be cleaned, the cleaning of louvered windows is a particularly time consuming and laborious task. Typically, conventional, single blade rubber squeegies, sponges, towels, and other conventional tools used for single pane planar windows are also used without modification to clean louvered windows. While this presents no undue inconvenience where the number of louvers or windows which must be cleaned are small, the cleaning of a large number of louvered windows, as is typically encountered by a commercial cleaning service, presents a particularly time consuming and uneconomical portion of the cleaning job.

Therefore, what is needed is some means whereby louvered windows and other slat-like material, such as hanging drapes and venetian blinds and the like can be readily washed, scrubbed and otherwise processed with a minimum expenditure of labor and time.

BRIEF SUMMARY OF THE INVENTION

The present invention is a tool holder in combination with a pair of tools for use on slat-like material. The tool holder includes an upper handle segment and a lower handle segment which is rotatably coupled to the upper handle segment at a first end of the upper and lower handle segments. The upper and lower segments generally oppose each other and are cooperatively coupled to rotate toward and away from each other. The lower handle segment includes a tool holding portion. An adjustable tool holding element is rotatably coupled to the upper handle segment. The tool holding portion of the lower handle segment opposes the adjustable tool holding element which is rotatably coupled to the upper handle segment. The adjustable tool holding element is selectively adjustable with respect to the upper tool holding segment so as to be configurable in a substantially parallel alignment to the tool holding portion of the lower handle segment. By virtue of this combination of elements, tools disposed in the adjustable tool holding element and in the tool holding portion are aligned in an opposing parallel configuration regardless of the degree of opening of said upper and lower handle segments and regardless of the distance of separation of the tools disposed in the tool holding portion and tool holding element of the upper and lower handle segments respectively.

The adjustable tool holding element includes a guide post integrally formed therewith which generally extends towards the opposing tool holding portion of the lower handle segment. Slot-like material, which is disposed between the tools which are engaged by the tool holding portion of tool holding element, is thus restrained from further disposition between the upper and lower handle segments beyond the limit defined by the guide post.

The adjustable tool holding element and the tool holding portion of the lower handle segment are formed into a generally hollow, cyclindrical shape with an elongated longitudinal axis and include in a slot defined therein which runs the length of the longitudinal axis. The tools are inserted in the hollow, cylindrically shaped tool holding element and tool holding portion, and extend therefrom through the longitudinal slot defined therein.

The upper and lower handle segments each include a hand-grip portion. The hand-grip portion of the upper handle segment is formed between the first and second end where the upper handle segment rotatably couples to the adjustable tool holding element. The hand-grip portion of the lower handle segment is formed between the first end of the lower handle segment and the tool holding portion of the lower handle segment. The tool holding portion of the lower handle segment extends from the corresponding hand-grip portion to form a second end of the lower handle segment distal from the first end.

This and other embodiments of the present invention can be best understood by viewing the following Figures, wherein like elements are referenced by like numerals, in light of the Detailed Description of the Preferred Embodiments.

Brief Description of the Drawings

FIG. 1 is a side elevational view of the tool holder of the present invention.

FIG. 2 is a top elevational view taken through line 2—2 of FIG. 1.

FIG. 3 is an end elevational view taken through line 3—3 of FIG. 1.

FIG. 4 is cross sectional view in enlarged scale taken through line 4—4 of FIG. 1.

FIG. 5 is a side view of the upper tool holding element shown in FIG. 1.

FIG. 6 is a top elevational view as taken through line 6—6 of the element shown in FIG. 5.

FIG. 7 is an end elevational view taken through line 7—7 of the element shown in FIG. 5.

DETAILED DESCRIPTION OF THE PREFERRED EMBODIMENT

The present invention is a tool holder particularly adapted for use with slat-like materials such as glass louvers, venetian blinds, vertical hanging slat drapes and the like. The thickness of such slat-like material varies from the very thin in the case of venetian or slat-like hanging drapes to one-quarter inch or more in the case of a glass louvered window. The normal tedious and laborious task of cleaning, scraping, painting, dusting, washing or otherwise applying some type of tool to both opposing surfaces of such slat-like material can be sustantially lessened with the use of the tool of the present invention.

As best shown in FIG. 1, tool 10 is a hand tool comprised of a first or upper handle segment and an opposing lower or second handle segment 14. Handle segments 12 and 14 are rotatably coupled together at a first end 16 of each handle segment by means of a conventional pivot pin 18 shown in side view of FIG. 1 and better shown in plan view in dotted outline in FIG. 2. In the illustrated embodiment, pin 18 includes a threaded bushing 20 having two opposing screws 22 threadibly engaging internal threading provided in bushing 20. It is entirely within the scope of the present invention, however, that many other means well known to the art may be substituted for pivot 18 without departing from the spirit and scope of the present invention.

Handle segments 12 and 14 are each characterized by a grip portion 24 which is particularly configured and adapted to provide a confortable fit to a user's hand. As indicated in FIG. 1, portion 24 of upper handle segment 12 is rounded downward slightly to comfortably fit the palm of a user's hand while portion 24 of lower handle segment 14 is provided with a gentle convex surface to comfortably fit the middle portion of the user's encircling fingers. As better seen in FIG. 2, handle segments 12 and 14 may be fabricated from die-formed sheet metal according to conventional means, thereby forming an integral body 26, and a light, yet rigid, hand grip portions 24 and 24'.

FIGS. 1 and 2 illustrate a conventional torsion spring 23 disposed about pivot 18. Spring 23 includes two extended legs 25 and 27, the ends of which bear against the internal walls of upper handle segment 12 in one case and lower handle segment 14 in the other case. The bias of spring 23 is choosen such that spring 23 will always urge handle segments 12 and 14 to rotate away from each other. Spring 23 may be wound about pivot 18 or may be concentrically disposed around pivot 18 according to well known principles and design choice.

Lower handle segment 14 is particularly characterized by a means for engaging a tool element, namely, extended tool holding portion 28 best shown in FIG. 1. Tool holding portion 28 is integral with hand grip portion 24 and is formed as an extension of the same wall material 26 that forms the entirity of lower handle segment 14. As better seen in FIG. 3, tool holding portion 28 is formed to assume the general shape of a hollow cylinder defining an interior space and extending from hand grip portion 24 away from first end 16 to second end 32 (shown in FIG. 1) which defines the opposing extremity of lower handle segment 14. Referring again to FIG. 3, tool holding portion 28 is particularly characterized by an upper slot 34 running the longitudinal length of tool holding portion 28, the longitudinal run of which is better shown in FIG. 2 in plan view. Detail of tool holding portion 28 is best shown in enlarged scale in FIG. 4 taken through line 4—4 of FIG. 1 and will be described in greater detail below.

FIG. 5 illustrates an adjustable tool holding element, generally denoted by reference numeral 36, shown apart from tool 10. Tool holding element 36 includes a similarly configured hollow cylindrical portion 38 having a longitudinal slot 40 running along the length of portion 38 as best illustrated in FIG. 6. Cylindrical portion 38 is integral with and extends to a lobe 42 and guide post 44 as seen in FIG. 5. Lobe 42 as shown in FIG. 5 has a smooth pivot bore 46 defined therethrough and a threaded bore 48 also defined in lobe 42. Pivot bore 46 is approximately aligned with tool holding portion 38 of tool holding element 36 and is adapted to receive, as best shown in FIG. 2, a pivot pin 50. In the illustrated embodiment, pivot pin 50 is a double-headed rivet. A clearance, provided between pivot pin and bore 46, allows tool holding element 36 to be easily rotated with respect to upper handle segment 12 as shown in FIG. 1 and yet has a close enough tolerances to prevent undue wobbling or unsecure rotatable coupling of tool holding element to upper handle segment 12.

Referring to FIG. 2, a conventional wing tipped bolt 52 is coupled to threaded bore 38, and as shown in FIG. 1 is disposed through an arcuate slot 54 defined in an enlarged side portion 56 of upper handle segment 12. Thus, tool holding element 36 rotates about pivot 50 thereby displacing winged bolt 42 within slot 54. When the desired angular orientation of tool holding elements 36 with respect to upper handle segment has been achieved, winged bolt 42 is tightened and the selected orientation is temporarily fixed. Clearly, many other types of adjustment means may be substituted in place of winged bolt 52 and slot 54, such as providing a fixed stub embedded in bore 48 and extending through slot 54. A winged nut may then be threadibly engaged to the end of the embedded stub with equal ease.

Referring again to FIG. 5, guide post 44 is integral with and extends in a generally perpendicular direction from tool holding section 38 of tool holding element 36. As best seen in FIG. 1, tool holding element 36 is configured to oppose tool holding portion 28 with post 44 extending therebetween. Tool elements 58, which in the case of the illustrated embodiment are symbolically shown as squeegee blades 58 are disposed in tool holding portion 38 and 28, as described in greater detail below, with guide post 44 providing a right hand guide or stop member adjacent the inner ends 60 of tool elements 58. Thus, when the slat-like material is disposed between tool elements 58, the edge of the slat like material is brought to bear against guide post 44, not only as a means for facilitating the proper alignment of tool elements 58 to the slat-like material, but also for preventing the slat-like material from being disposed between upper handle segment 12 and lower handle segment 14 where tool elements 58 might not otherwise engage opposing surfaces of the slat-like material or where the slat-like material might otherwise be damaged. Thus, guide post 44 not only protects the slat-like material from damage and also automatically guides the user by feel to the appropriate alignment of tool elements 58 to the slat-like material and maintains the appropriate alignment while the tool is being used. In other words, the user pushes and maintains guide post 44 against the edge of the slat-like material. The resistive force exerted by the slat-like material against guide post 44 provides an indication to the user that the tool is appropriately aligned during its use.

Refer again to FIG. 4 wherein tool element 58 is disposed in tool holding portion 28. Although FIG. 4 illustrates an engagement between a tool element 58 and tool holding portion 28 of lower handle segment 14, it must be understood that the same configuration and operation is assumed with respect to tool element 58 when disposed in tool holding portion 38 of adjustable tool holding element 36. In the illustrated embodiment tool element 58 is shown a rubber squeegee which is comprised of a rigid fixture 62 in which a pliable blade 64 has been disposed. Such squeegee blades are well known to the art. Pliable blade 64 includes a root portion 66 disposed in a mating cylindrical channel 68 defined by fixture 62. Fixture 62 also includes a supporting lip 70 which extends through slot 34 and inclines outwardly at a predetermined inclination. When the squeegee blade is moved in the direction as shown by the arrow in FIG. 4, pliable blade 64 will bend backwardly and be urged against supporting lip 70. Similarly, the force exerted by pliable blade 64 against lip 70 causes blade fixture 62 to rotate in a counterclockwise direction as illustrated in FIG. 4 until supporting lip 70 comes to bear against the adjacent edge of slot 34. The width of slot 34 is chosen so that when supporting lip 70 bears against slot 34, pliable blade 64 will be inclined at a predetermined angle. Squeegee blades are well known and conventionally drawn across the surface to be cleaned at a slightly rearward angle. This of course, provides for the smooth scraping action of the leading edge of pliable blade 64 and prevents jumping and skipping which would occur if pliable blade 64 were inclined in a forwardly disposed direction and pushed across the surface to be cleaned.

Slot 34 is of sufficient width to allow supporting lip 70 to be fixed at the conventionally predetermined angle of inclination with respect to the direction of movement as indicated by the arrow of FIG. 4. Blade fixture 62 and blade 64 are however symmetrical from end-to-end. Thus, the squeegee blade may be removed from tool holding portion 28, reversed end-to-end and reinserted such that supporting lip 70 is disposed adjacent to the side of slot 34 opposite that illustrated in FIG. 5. In this instance, the squeegee blade will be oriented for movement in a direction opposite that shown in FIG. 4. In the same manner, the symmetrical configuration of slot 34 with respect to tool holding portion 28 allows supporting lip 70 to rotate against the adjacent side of slot 34 to assume the mirror image configuration from that shown in FIG. 4 and to allow smooth movement in the opposing direction. The direction of movement will normally be reversed to allow left-handed and righthanded use. For example, a right handed person, holding tool 10 in the right hand will normally move the tool from an outwardly extended position from right to left. A lefthanded person, holding the tool, in the the left hand, would move the tool in the opposite direction, namely from left to right. In such an instance, the squeegee blades can be easily reversed within tool holding portion 28 and within adjustable tool holding element 36 with complete ambidexterity.

Although the illustrated embodiment has been described in respect to a rubber squeegee, it must be understood that tool element 58 could include any type of tool well known to the art having a means configured to be slidingly disposed within tool holding portion 28 and tool holding element 36. For example, tool element 58 could equally include a rounded sponge attached to tool holding portions 28 and tool holding element 36 in a similar to that manner shown for blade 64 and blade fixture 62. Thus, the slatlike material may be washed and soaped by a pair of appropriately wetted sponge bars used in place of the squeegee blades illustrates in FIGS. 1 and 4. Similarly, a blade shaped bristle brush could also be adapted for disposition within tool holding portion 28 and tool holding element 36 and used for dusting or painting.

Yet another example for alternative type of tool for tool element 58 includes a tool having a scraping edge, such as a razor blade edge which would similarly captively fit within tool holding portion 28 and tool holding element 36 and extend through slot 34 as described. In such a case, a cutting edge could be directed in a forwardly inclined direction opposite to that shown and described with respect to the squeegee in FIG. 4 by an appropriately designed tool fixture for disposition within tool holding portion 28 and tool holding element 36 using the principles described above.

Use of tool 10 can now be briefly described. The selected tool element 58 is choosen and inserted by slidingly disposing tool element 58 within opposing tool holding portions 38 and 28. Winged bolt 52 is then loosened to allow tool holding element 36 to freely rotate. The user grasps upper and lower handle segments 12 and 14 and disposes the slat-like material between the edges of opposing tool elements 58. Handle segments 12 and 14 are then rotated towards each other until the upper edge of tool element 58, which is engaged by tool holding portion 28, contacts one surface of the slat-like material and until the lower edge of tool element 58, engaged by adjustable tool holding element 36, flatly engages the opposing surface of the slat-like material. The angular orientation of adjustable tool holding element 36 is then adjusted until the entire lower surface of the corresponding tool element 58 contacts the adjacent surface of the slat-like material. Wing bolt 52 is then tightened so that the selected orientation is temporarily fixed. Guide post 44 is then disposed against the adjacent edge of slat-like material disposed between tool elements and tool 10 is then run across the longitudinal length of the slat-like material with the contacting edges of tool elements 58 engaging the opposing surfaces of the slat-like material with a pressure as determined by the user's grip. The orientation of the contacting edge of tool element 58 is determined according to the particular type of tool fixture and its engagement with the adjacent edges of slot 34, in the case of tool holding portion 28 of lower handle 14, and with the adjacent edges of slot 40 in the case of tool holding element 36. Thus, where rubber squeegee are inserted as tools, the washed and soaped louver glass, venetian window blind, or vertical hanging slat drape is simultaneously cleaned on both opposing surfaces with a single smooth motion of tool 10.

It must be understood that many modifications and alterations may be made by those having ordinary skill in the art wihtout departing from the spirit and scope of the present invention. The illustrated embodiment has been shown only for the purposes for clarity and should not be taken as limiting or defining the scope of the following claims.

I claim:

1. A tool for cleaning slat-like material comprising:

elongated upper and lower handle segments rotatably connected together at their one ends and projecting coextensively therefrom to form respective second ends;

bias means resiliently urging said second ends of said handle apart;

elongated upper and lower tool holding portions projecting coextensively in confronting relationship from said second ends, said lower tool holding portion being mounted from said second end of said lower handle segment;

pivot means coupling one end of said upper tool holding element to said second end of said upper handle segment to provide for pivoting of said upper tool holding portion relative to said upper handle segment to enable said upper tool holding portion to be adjusted for parallel alignment with said lower tool holding portion;

adjustment means mounted on said upper handle segment and operable to releasably secure said upper tool holding element in selected angular portions relative to said upper handle segment; and a pair of tool assemblies, one mounted on each of said tool holding elements to be disposed in confronting relationship whereby a workman may release said adjustment means, grasp said handle segments, insert said tool holding elements on opposite sides of said slat-like material to position said tool assemblies astraddle of said material, close said handle to the degree necessary to force said tool assemblies against said material with the desired pressure and then tighten said adjustment means to releasably fix said upper tool holding element to cause said upper tool assembly to remain fixed relative to said upper handle segment during repeated use in passing said tool assemblies along said slat-like material.

2. The tool holder of claim 1 wherein said upper tool holding portion includes a guide post integrally formed therewith and generally extending toward said opposing tool holding portion of said lower handle segment, whereby slat-like material disposed between said tools engaged by said tool holding portion and tool holding portion is restrained from further disposition between beyond a limit defined by said guide post.

3. A tool as set forth in claim 1 wherein:

said tool holding segments are generally in the form of a hollow cylinder formed on their confronting sides with respective open ended slots of a predetermined width;

said tool assemblies are in the form of blade assemblies including upper and rigid blade holders received in said slots of said upper and lower tool portions and pliable blade wipers, said lower tool holding segment being formed on one side with a support lip projecting laterally from one side of said slot and configured to cooperate with said blade holder to form a transverse width less than said predetermined width and provide for rotation of said lower blade in said lower tool holding portion and to engage said one side of said lower slot to limit such rotation in one direction thereby establishing an angle of the projecting blade dictating the preferred direction of wiping of said blade along said slat-like material.

4. A tool as set forth in claim 1 wherein:

said adjustment means includes an arcuate slot formed in said upper handle portion and screw means mounted from said upper tool holding portion and projecting through said slot, said screw means including a nut for tightening down to functionally engage said upper handle portion to prevent relative movement between said upper handle and tool holding portions.

5. The tool holder of claim 1 wherein:

said tool holding portion of said handle segments are formed in generally hollow cylindrical shapes with longitudinal axes, including slots defined therein running the length of said longitudinal axis, said tool assemblies being inserted in said hollow, cylindrically shaped tool holding portions, said tools extending laterally therefrom through said longitudinal slots defined in said tool holding portions.

* * * * *